US010786711B2

(12) United States Patent
Chuang et al.

(10) Patent No.: US 10,786,711 B2
(45) Date of Patent: Sep. 29, 2020

(54) CUSTOMIZABLE GOLF CLUB HEAD

(71) Applicant: Chi-Shun Chuang, Taichung (TW)

(72) Inventors: Chi-Shun Chuang, Taichung (TW); Chung-Chao Wang, Taichung (TW)

(73) Assignee: Chi-Shun Chuang, Taichung (TW)

( * ) Notice: Subject to any disclaimer, the term of this patent is extended or adjusted under 35 U.S.C. 154(b) by 0 days.

(21) Appl. No.: 16/531,662

(22) Filed: Aug. 5, 2019

(65) Prior Publication Data

US 2020/0061425 A1 Feb. 27, 2020

(30) Foreign Application Priority Data

Aug. 22, 2018 (TW) ..... 107211498 U

(51) Int. Cl.
*A63B 53/04* (2015.01)

(52) U.S. Cl.
CPC .. *A63B 53/0466* (2013.01); *A63B 2053/0416* (2013.01)

(58) Field of Classification Search
CPC ..... A63B 60/42; A63B 53/0466; A63B 2053/0416; A63B 2209/00; A63B 60/02
See application file for complete search history.

(56) References Cited

U.S. PATENT DOCUMENTS 4,429,879 A * 2/1984 Schmidt ..... A63B 53/04 473/346
5,967,905 A * 10/1999 Nakahara ..... A63B 53/04 473/345
6,626,769 B1 * 9/2003 Lin ..... A63B 53/0466 473/345
6,783,466 B2 * 8/2004 Seki ..... A63B 53/04 473/345
6,949,031 B2 * 9/2005 Imamoto ..... A63B 53/0466 473/329
RE39,178 E * 7/2006 Allen ..... A63B 53/04 473/287
8,262,497 B2 * 9/2012 Breier ..... A63B 53/0466 473/244
8,647,217 B2 * 2/2014 Nishio ..... A63B 53/04 473/342
2018/0099188 A9 * 4/2018 Mitzel ..... A63B 53/0466

FOREIGN PATENT DOCUMENTS

GB 2317346 A * 3/1998

* cited by examiner

*Primary Examiner* — Stephen L Blau
(74) *Attorney, Agent, or Firm* — Muncy, Geissler, Olds & Lowe, P.C.

(57) ABSTRACT

A golf club head includes a club head body having a first slot and a second slot in communication with the first slot, a first cover plate affixed to the club head body to cover the first slot, and a second cover plate affixed to the club head body to cover the second slot. The first cover plate and the second cover plate can be manufactured using the same or different materials, so that the position of the center of gravity of the overall structure differs depending on the material difference of the first cover plate and the second cover plate. In this way, the most suitable structural combination can be tailored for different users, so that each user can show the best ball hitting effect.

2 Claims, 5 Drawing Sheets

CUSTOMIZABLE GOLF CLUB HEAD

BACKGROUND OF THE INVENTION

1. Field of the Invention

The present invention relates to golf club head technology, and more particularly, to a customizable golf club head.

2. Description of the Related Art

The conventional golf club head is mainly made by casting technology in one piece and uses a mosaic method to fix a weight with the golf club head, so that the golf club head can play the best ball hitting effect.

In order to meet the weight requirements of different users, manufacturers must develop corresponding molds for each type of structural combination for manufacturing, but this will lead to the problem that the development costs are too expensive to meet the needs of customization.

SUMMARY OF THE INVENTION

The present invention has been accomplished under the circumstances in view. It is the main object of the present invention to provide a golf club head, which allows the most suitable structural combination to be tailored for different users, so as to achieve satisfying the needs of customization.

To achieve this and other objects of the present invention, a golf club head comprises a club head body, a first cover plate, and a second cover plate. The club head body comprises an arc-shaped top frame and an arc-shaped side frame. Both ends of the curved top frame are integrally connected to both ends of the curved side frame. The curved top frame and the curved side frame are not located on the same imaginary planes, so that a first slot and a second slot are formed therebetween and disposed in communication with each other. The first cover plate comprises a crown, and a ball-hitting face integrally downwardly extended from one end of the crown. The first cover plate covers the first slot of the club head body. The crown and ball-hitting face of the first cover plate are respectively affixed to the arc-shaped top frame and arc-shaped side frame of the club head body. The second cover plate covers the second slot of the club head body and is affixed to the arc-shaped top frame and arc-shaped side frame of the club head body.

As can be seen from the above, the first cover plate and the second cover plate can be manufactured using the same or different materials, so that the position of the center of gravity of the overall structure differs depending on the material difference of the first cover plate and the second cover plate. In this way, the most suitable structural combination can be tailored for different users, so that each user can show the best ball hitting effect.

Preferably, the arc-shaped top frame further comprises a first positioning groove located on an inner circumference thereof. The arc-shaped side frame further comprises a second positioning groove located on the outer side thereof and connected to the first positioning groove. The crown of the first cover plate comprises a first positioning convex portion located on an outer circumference thereof. The ball-hitting face of the first cover plate comprises a second positioning convex portion located on the inner side thereof and connected to the first positioning convex portion. The first positioning convex portion and the second positioning convex portion are respectively engaged in the first positioning groove and the second positioning groove.

More preferably, the second cover plate can be made of a material having a specific gravity greater than 7.8, such as stainless steel or tungsten nickel alloy.

The detailed construction, features, assembly or use of the golf club head provided by the present invention will be described in the detailed description of the subsequent preferred embodiment. However, those of ordinary skill in the art should understand that the detailed description and specific embodiments of the present invention are merely used to illustrate the present invention and are not intended to limit the scope of the patent application.

DETAILED DESCRIPTION OF THE INVENTION

Figure 1:
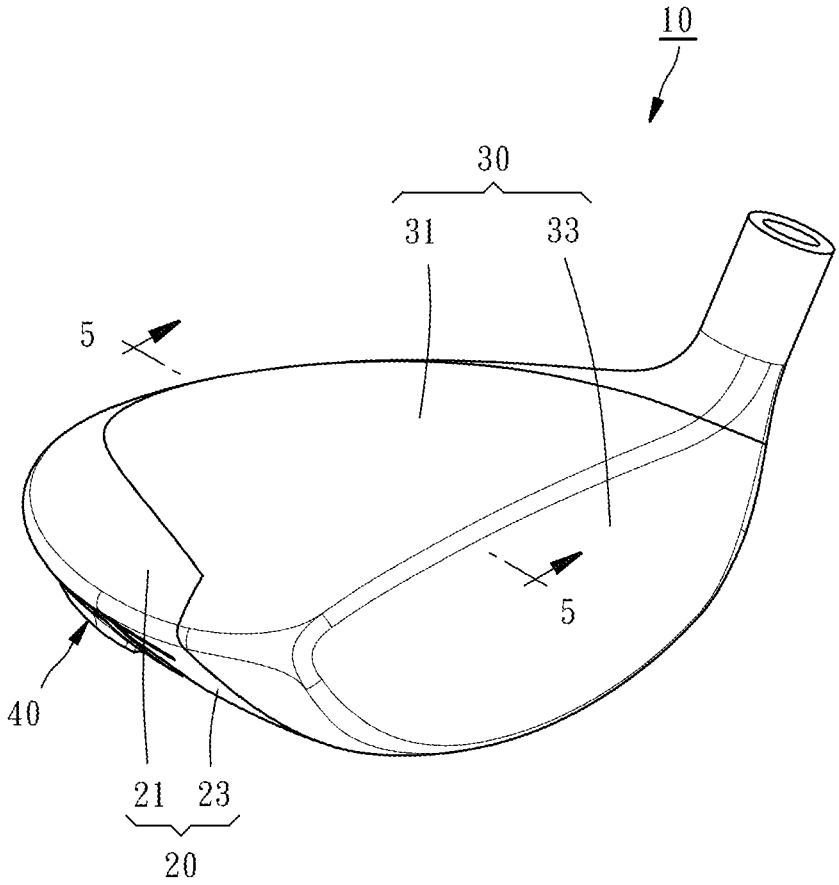
FIG. 1 is an oblique top elevational view of a golf club head in accordance with the present invention.

The applicant first explains here, in the embodiment and drawings, which will be described below, the same reference numerals denote the same or similar elements or structural features thereof.

Referring to FIGS. 1-4, a golf club head 10 in accordance with the present invention is shown. The golf club head 10 comprises a club head body 20, a first cover 30, and a second cover plate 40.

Figure 2:
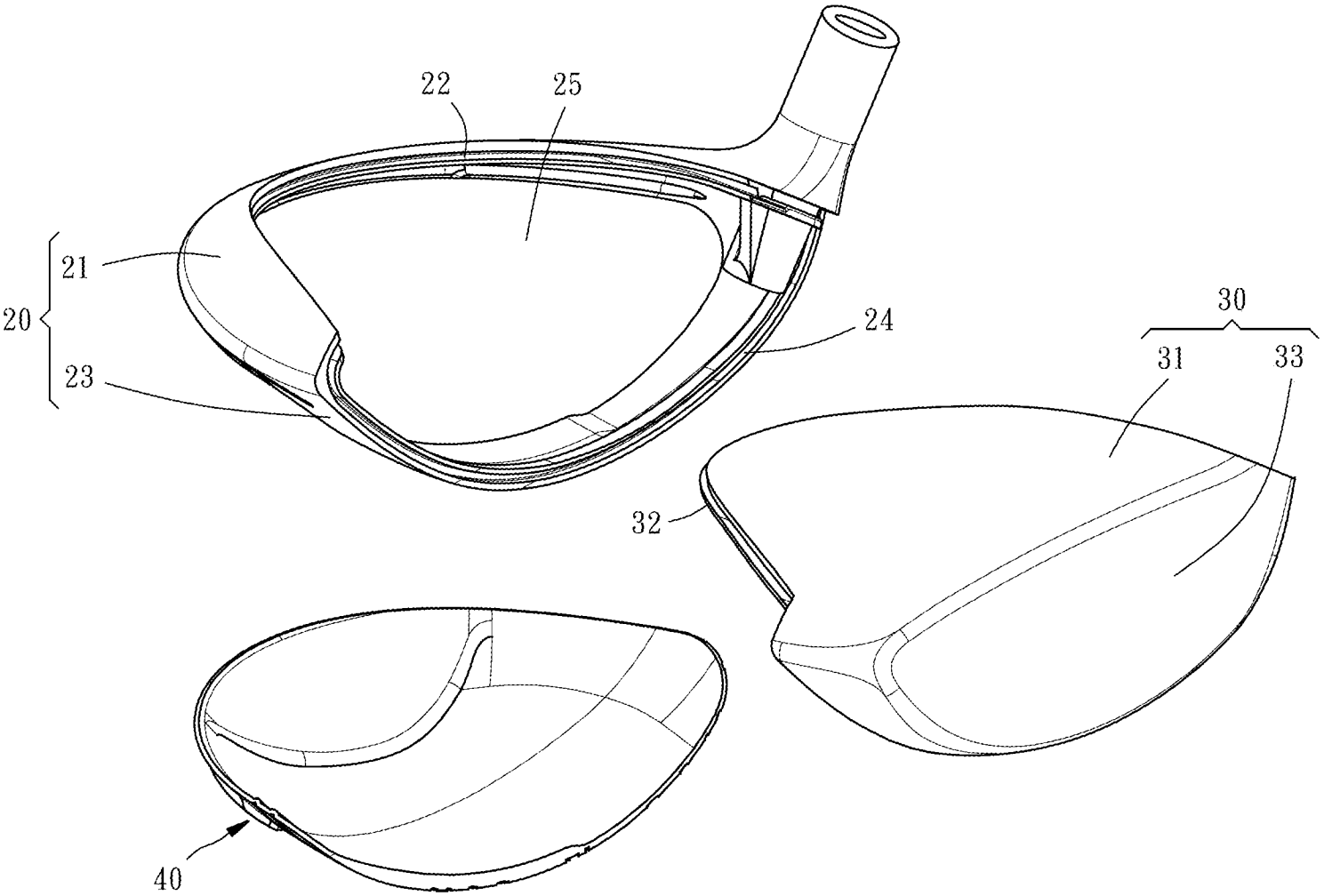
FIG. 2 is an exploded view of FIG. 1.
Figure 4:
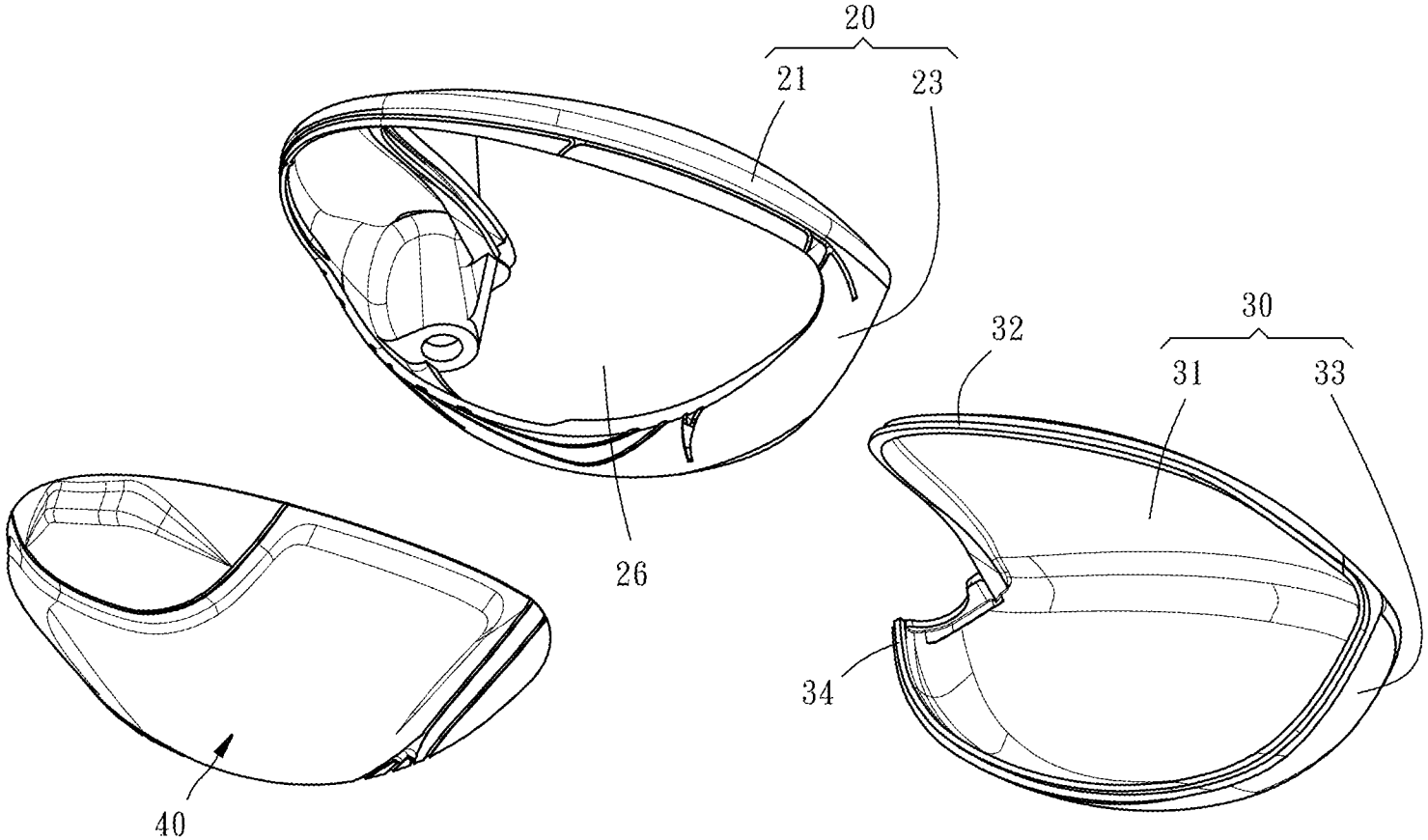
FIG. 4 is an exploded view of FIG. 3.

The club head body 20 is made of titanium, stainless steel, aluminum or carbon fiber in one piece. The club head body 20 comprises an arc-shaped top frame 21 and an arc-shaped side frame 23, and both ends of the curved top frame 21 are integrally connected to both ends of the curved side frame 23. Moreover, the curved top frame 21 and the curved side frame 23 are not located on the same imaginary plane, so that a first slot 25 (as shown in FIG. 2) and a second slot 26 (as shown in FIG. 4) are formed therebetween and disposed in communication with each other. More specifically, the arc-shaped side frame 23 is inclined downward by a predetermined angle with respect to the arc-shaped top frame 21 such that the top side of the arc-shaped top frame 21 and the outer side of the arc-shaped side frame 23 surround the first slot 25, the bottom side of the arc-shaped top frame 21 and the inner side of the arc-shaped side frame 23 surround the second slot 26.

Figure 3:
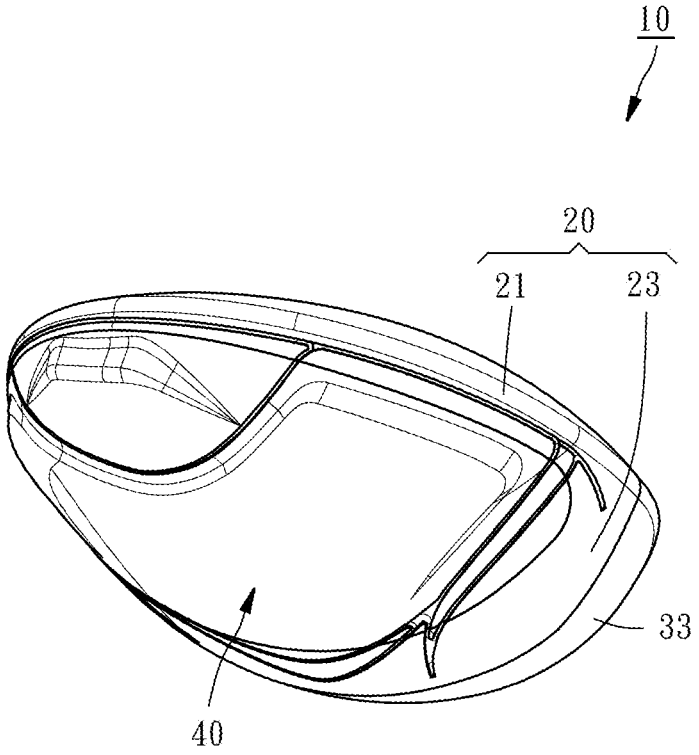
FIG. 3 is a bottom perspective view of the golf club head in accordance with the present invention.
Figure 5:
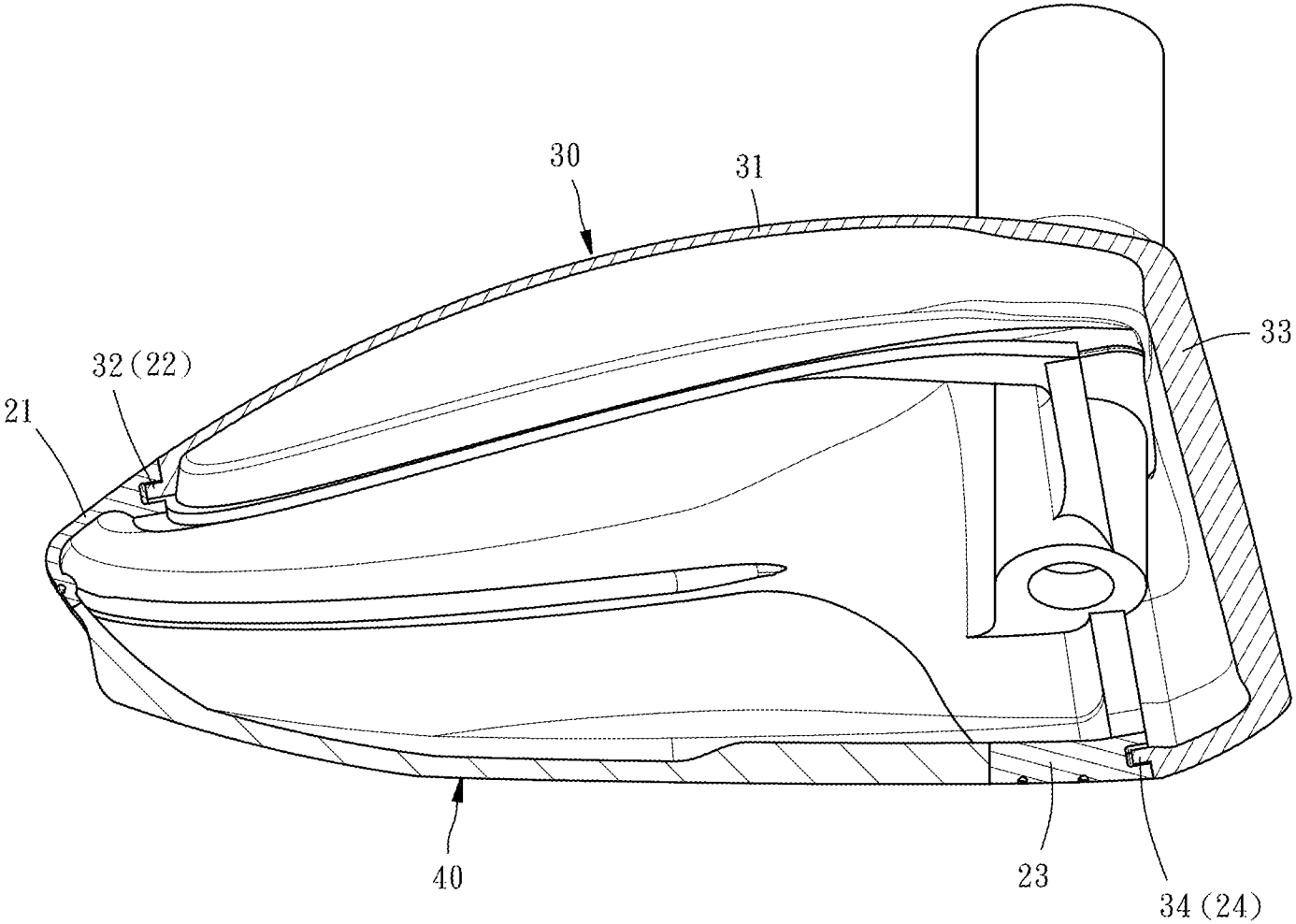
FIG. 5 is a sectional view taken along line 5-5 of FIG. 1.

The first cover 30 is made of titanium, stainless steel, aluminum or carbon fiber in one piece. The first cover 30 comprises a crown 31, and a ball-hitting face 33 integrally downwardly extended from one end of the crown 31. When assembled in the club head body 20, as shown in FIGS. 1 and 2, the outer circumference of the crown 31 of the first cover plate 30 and the inner side of the ball-hitting face 33 of the first cover plate 30 are respectively affixed to the inner circumference of the arc-shaped top frame 21 of the club head body 20 and the outer side of the arc-shaped side frame 23 of the club head body 20 by welding, so that the first cover plate 30 covers the first slot 25 of the club head body 20. In order to help the first cover plate 30 to complete the assembly alignment quickly, as shown in FIGS. 3-5, the inner circumference of the arc-shaped top frame 21 of the club head body 20 and the outer side of the arc-shaped side frame 23 of the club head body 20 may further be respectively provided with a first positioning groove 22 and a second positioning groove 24 that connects the first positioning groove 22, and the outer circumference of the crown 31 of the first cover plate 30 and the inner side of the ball-hitting face 33 of the first cover plate 30 may further be respectively provided with a first positioning convex portion 32 and a second positioning convex portion 34 that connects the first positioning convex portion 32. By means of engaging the first positioning convex portion 32 and second positioning convex portion 34 of the first cover plate 30 into the first positioning groove 22 and second positioning groove 24 of the club head body 20 respectively, the invention reduces errors that may occur during assembly, avoiding ball hitting interference due to assembly errors.

The second cover plate 40 is made of a material having a specific gravity greater than 7.8 (for example, stainless steel or tungsten-nickel alloy) in an integrally formed manner. When assembled in the club head body 20, as shown in FIGS. 3 and 4, the outer circumference of the second cover plate 40 is fixed to the bottom side of the arc-shaped top frame 21 of the club head body 20 and the inner side of the arc-shaped side frame 23 of club head body 20 by welding, so that the second cover plate 40 covers the second slot 26 of the club head body 20.

As can be seen from the above, the first cover plate 30 and the second cover plate 40 can be manufactured using the same or different materials, so that the position of the center of gravity of the overall structure differs depending on the material difference of the first cover plate 30 and the second cover plate 40. It is not necessary to develop a large number of different molds, so that the most suitable structural combination can be tailored for different users, so as to achieve cost saving and satisfying the needs of customization.

What is claimed is:

1. A golf club head, comprising:

a club head body comprising an arc-shaped top frame and an arc-shaped side frame, both ends of said curved top frame being integrally connected to both ends of said curved side frame, said curved top frame and said curved side frame being located on different imaginary planes, so that a first slot and a second slot are formed therebetween and disposed in communication with each other;

a first cover plate comprising a crown and a ball-hitting face integrally downwardly extended from one end of said crown, said first cover plate covering said first slot of said club head body, said crown and said ball-hitting face of said first cover plate being respectively affixed to said arc-shaped top frame and said arc-shaped side frame of said club head body; and a second cover plate covering said second slot of said club head body, said second cover plate being affixed to said arc-shaped top frame and said arc-shaped side frame of said club head body;

wherein said arc-shaped top frame defines a top side and a bottom side; said arc-shaped side frame defines an outer side and an inner side; said first slot is surrounded by said top side of said arc-shaped top frame and said outer side of said arc-shaped side frame; said second slot is surrounded by said bottom side of said arc-shaped top frame and said inner side of said arc-shaped side frame;

wherein said arc-shaped top frame further comprises a first positioning groove located on an inner circumference thereof; said arc-shaped side frame further comprises a second positioning groove located on the outer side thereof and connected to said first positioning groove; said crown of said first cover plate comprises a first positioning convex portion located on an outer circumference thereof; said ball-hitting face of said first cover plate comprises a second positioning convex portion located on the inner side thereof and connected to said first positioning convex portion; said first positioning convex portion and said second positioning convex portion are respectively engaged in said first positioning groove and said second positioning groove.

2. The golf club head as claimed in claim 1, wherein said second cover plate is made of a material having a specific gravity greater than 7.8.

* * * * *